US007044821B2

(12) United States Patent
Kogure et al.

(10) Patent No.: US 7,044,821 B2
(45) Date of Patent: May 16, 2006

(54) METHOD OF MANUFACTURING A PLASMA DISPLAY PANEL BY DECOMPOSING IMPURITIES IN EXHAUST GAS WITH A CATALYST

(75) Inventors: Junji Kogure, Shizuoka (JP); Masaaki Nakamura, Shizuoka (JP); Mineaki Yokoyama, Shizuoka (JP)

(73) Assignees: Pioneer Corporation, Tokyo (JP); Pioneer Display Products Corporation, Shizuoka (JP)

( * ) Notice: Subject to any disclaimer, the term of this patent is extended or adjusted under 35 U.S.C. 154(b) by 83 days.

(21) Appl. No.: 10/735,640

(22) Filed: Dec. 16, 2003

(65) Prior Publication Data

US 2004/0180601 A1 Sep. 16, 2004

(30) Foreign Application Priority Data

Dec. 25, 2002 (JP) ..... P. 2002-373379

(51) Int. Cl.
*H01J 9/24* (2006.01)

(52) U.S. Cl. ..... 445/24; 438/905; 438/903

(58) Field of Classification Search ..... 445/73, 445/23–25, 40, 41, 66, 70; 438/781–782, 438/903, 905, 795, 798
See application file for complete search history.

(56) References Cited

U.S. PATENT DOCUMENTS

2005/0118810 A1* 6/2005 Harada et al. ..... 438/687

FOREIGN PATENT DOCUMENTS

| | | | |
|---|---|---|---|
| JP | 11-149873 A | | 6/1999 |
| JP | 2004316987 A | * | 11/2004 |
| JP | 2005228682 A | * | 8/2005 |

* cited by examiner

*Primary Examiner*—Joseph Williams
*Assistant Examiner*—Dalei Dong
(74) *Attorney, Agent, or Firm*—Sughrue Mion, PLLC

(57) ABSTRACT

Plural first exhaust pipes are disposed as exhaust paths at an upper portion of a heat treatment apparatus. Exhaust gases are discharged from the inside of the heat treatment apparatus to the respective exhaust pipes. Inlets of catalyst units are connected to outlets of the first exhaust pipes, and second exhaust pipes are connected to outlets of the catalyst units. Exhaust gases are discharged from exhaust ports of the second exhaust pipes to the outside (e.g., the atmosphere) of the heat treatment apparatus.

6 Claims, 9 Drawing Sheets

FIG. 8 (b)

| NO. | SUBSTANCE NAME | CHEMICAL FORMULA | CONCENTRATION (ppm) | SPACE VELOCITY ($h^{-1}$) |
|---|---|---|---|---|
| 1 | | $H_2$ | 1% | 60,000 |
| 2 | | CO | 1,000 | 60,000 |
| 3 | | $CH_3OH$ | 100 | 30,000 |
| 4 | | $C_2H_4$ | 5,000 | 60,000 |
| 5 | | $C_6H_{10}O$ | 550 | 60,000 |
| 6 | | $C_6H_5CH_3$ | 550 | 60,000 |
| 7 | | $C_2H_5COCH_3$ | 650 | 60,000 |
| 8 | | $(CH_3)_2S$ | 10 | 30,000 |
| 9 | | $C_6H_4(CH_3)_2$ | 550 | 60,000 |
| 10 | | $NH_3$ | 300 | 30,000 |
| 11 | | $(CH_3)_3N$ | 30 | 30,000 |
| 12 | | $CH_3CHO$ | 140 | 30,000 |
| 13 | | $C_2H_5OH$ | 300 | 30,000 |
| 14 | | $CH_3C_6H_4OH + C_6H_5OH$ | 660 + 440 | 60,000 |
| 15 | | $(C_2H_5)_3N$ | 300 | 30,000 |
| 16 | | $CH_3COOH$ | 100 | 30,000 |
| 17 | | $HCON(CH_3)_2$ | 740 | 60,000 |

FIG. 10

| CATALYST TYPE | METAL HONEYCOMB CATALYST | CERAMIC HONEYCOMB CATALYST | PELLET CATALYST |
|---|---|---|---|
| CATALYST TYPE | | | |
| BASIC COMPOSITION | Fe-Cr-Al | $SiO_2$-$Al_2O_3$-MgO | Y-$Al_2O_3$ |
| COEFFICIENT OF HEAT CONDUCTIVITY | LARGE | SMALL | SMALL |
| FILLED SPECIFIC GRAVITY | 0.4 TO 0.6 | 0.6 TO 0.7 | 0.4 TO 0.8 |
| HEAT CAPACITY | SMALL | MODERATE | LARGE |
| STANDARD SV VALUE | 30,000 TO 60,000 $h^{-1}$ | 20,000 TO 40,000 $h^{-1}$ | 10,000 TO 30,000 $h^{-1}$ |
| PRESSURE LOSS (*) | 5.5 | 7.1 | 41.5 |
| MECHANICAL STRENGTH | STRONG | WEAK | MODERATE |
| THERMAL SHOCK RESISTANCE | STRONG | WEAK | MODERATE |

(*: MEASURED VALUE UNDER AN ATMOSPHERE OF 200°C AND 1 Nm/s.)

METHOD OF MANUFACTURING A PLASMA DISPLAY PANEL BY DECOMPOSING IMPURITIES IN EXHAUST GAS WITH A CATALYST

The present disclosure relates to the subject matter contained in Japanese Patent Application No.2002-373379 filed on Dec. 25, 2002, which is incorporated herein by reference in its entirety.

BACKGROUND OF THE INVENTION

1. Field of the Invention

The present invention relates to a plasma display panel manufacturing method and a heat treatment apparatus.

2. Description of the Related Art

First, the structure of a common plasma display panel (referred to below as a PDP) will be described below as an example of a plasma display panel. FIG. 1 is an exploded perspective diagram showing the internal structure of the PDP, and FIG. 2 is a plan diagram schematically showing the structure of row electrode pairs 2 (X, Y) of the PDP.

In FIG. 1, plural row electrode pairs 2 (X, Y), a dielectric layer 3 that covers the row electrode pairs 2 (X, Y) and a protective layer 4 including MgO that covers the dielectric layer 3 are successively formed on an inner surface of a front panel 1 that serves as a display surface. Each row electrode pair 2 includes a transparent electrode 2*a*, which has a wide transparent conductive film such as ITO, and a metal electrode (bus electrode) 2*b*, which has a narrow metal film that supplements the conductivity of the transparent electrode 2*a*.

On the other hand, partition walls 9 and phosphor layers 7R, 7G, and 7B of the three primary colors are formed on a back-side back glass panel 5, which is disposed so as to face the front panel 1 via the discharge space 8. The partition walls 9 are aligned in a direction orthogonal to the row electrode pairs 2 (X, Y), are disposed in bands between column electrodes 6 to form a display cell at each intersection portion, and partition a discharge space 8. The phosphor layers 7R, 7G and 7B of the three primary colors are disposed so as to cover the column electrodes 6 and side surfaces of the partition walls 9 with respect to the discharge space 8. A noble gas is charged and sealed inside the discharge space 8.

As shown in FIG. 2, the row electrode pairs 2 (X, Y) are alternatingly aligned column-wise so as to correspond to one line L of a matrix display and be adjacent at each line L with a discharge gap G sandwiched therebetween. At each line L, a display cell (discharge cell) is demarcated into unit light-emitting regions E by the row electrode pairs 2 (X, Y).

Next, the display operation of the display in the above PDP will be described.

First, ON cells (cells in which a wall charge is formed) and OFF cells (cells in which a wall charge is not formed) are selected by an address operation resulting from selective discharge between the column electrodes 6 and the row electrode pairs 2 (X, Y) shown in FIG. 2. After the address operation, a discharge sustain pulse is applied, with respect to the row electrode pairs X and Y, at once to all of the lines L, whereby surface discharge arises in the ON cells each time the discharge sustain pulse is applied. The phosphor layers 7R, 7G and 7B are excited by ultraviolet light generated by this surface discharge and caused to emit visible light.

[Patent Document 1]

JP-A-11-149873 (p. 2, FIGS. 7 and 8)

In the process of manufacturing a PDP such as the one described above, a heat treatment step is included in part of a formation step of a structure such as the electrodes, the partition walls, the phosphor layers, the dielectric layer and a black stripe layer. For instance, in the formation step of the dielectric layer, a glass paste including a mixture of glass powder, resin and a solvent is coated on a substrate, and the coated substrate is heat treated using a heat treatment apparatus such as a kiln.

A method of discharging exhaust gas of the heat treatment apparatus used in the heat treatment step will be described using the schematic diagram of FIG. 3, which shows a heat treatment apparatus.

As shown in FIG. 3, plural (three) exhaust pipes 111 are disposed at an upper portion of a heat treatment apparatus 110, and exhaust gas 112 generated from the inside of the heat treatment apparatus 110 is discharged from each exhaust pipe 111 to the outside (the atmosphere) of the heat treatment apparatus 110.

Thus, in the heat treatment step during the manufacture of the PDP, although resin components and solvent components are vaporized and removed at the time of the heat treatment, they are included as impurities in the exhaust gas 112 of the heat treatment apparatus 110. There is the potential for them to be diffused to the outside (the atmosphere) when they are discharged from the exhaust pipes 111.

SUMMARY OF THE INVENTION

Eliminating the problem occurring in the aforementioned prior art—i.e., preventing the diffusion to the outside (the atmosphere) of impurities generated in a heat treatment step during the manufacture of a PDP-can be given as one example of the problem that the invention attempts to solve.

In order to achieve this object, according to a first aspect of the invention, a plasma display panel manufacturing method includes forming a structure, wherein the forming of the structure includes forming a precursor layer containing at least one of a resin component and a solvent component on a substrate, and heat-treating the substrate on which the precursor layer has been formed; and decomposing impurities included in exhaust gas generated in the heat treatment by action of a catalyst.

Also, according to a second aspect of the invention, a heat treatment apparatus is used in a heat treatment where a substrate on which a precursor layer including at least one of a resin component and a solvent component is formed, is heat-treated. The heat treatment apparatus includes a catalyst unit including a catalyst disposed on an exhaust path where an exhaust gas generated in the heat treatment is discharged.

BRIEF DESCRIPTION OF THE DRAWINGS

FIG. 10 shows a table in which the properties of various catalysts are structurally/compositionally-distinguished and compared.

DETAILED DESCRIPTION OF THE PREFERRED EMBODIMENTS

An embodiment of the invention will be described in detail below with reference to the drawings.

A plasma display panel (PDP) manufacturing method according to the embodiment of the invention includes a heat treatment step, such as drying, calcinating or baking, in part of a formation step of a structure (structure formation step) of electrodes, partition walls, phosphor layers, a dielectric layer or a black stripe layer (outside light reflection prevention layer) of the PDP. The heat treatment step is one in which a paste-like material layer (a precursor layer including a resin component and/or a solvent component) that is formed on a substrate and serves as a structure are heat-treated by a heat treatment apparatus (a drying furnace, a kiln or a baking furnace).

The present embodiment is characterized in that impurities are removed and discharged from exhaust gas including a resin component and a solvent component generated in the heat treatment step. A heat treatment apparatus and a method of discharging the exhaust gas, which are characteristics of the present embodiment, will be described in detail below with reference to the drawings.

Figure 4:
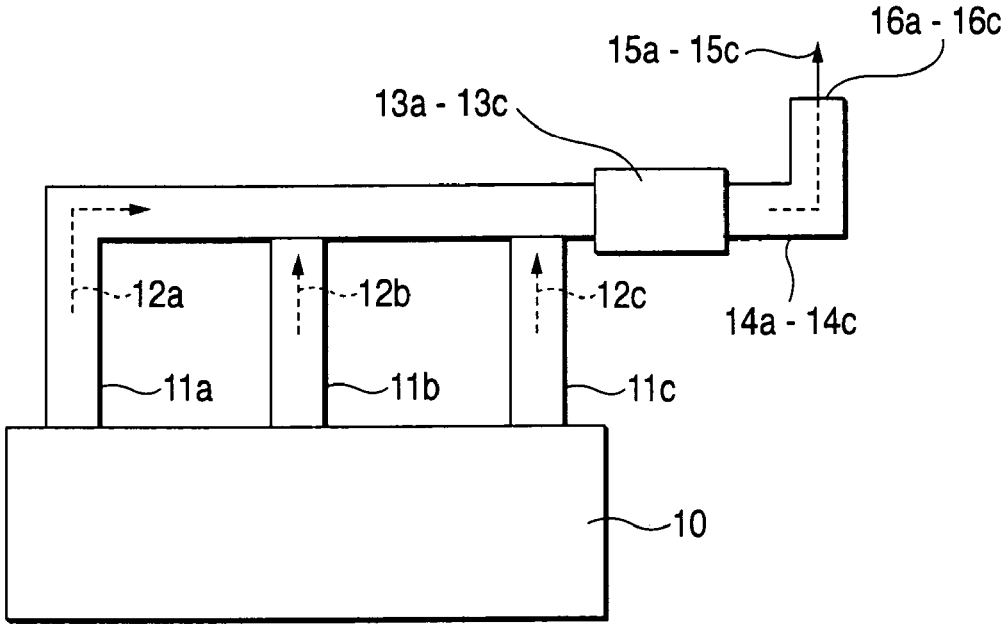
FIG. 4 is a schematic front diagram showing heat treatment apparatus exhaust paths for describing an exhaust method of a heat treatment apparatus in a PDP manufacturing method of an embodiment pertaining to the invention.
Figure 5:
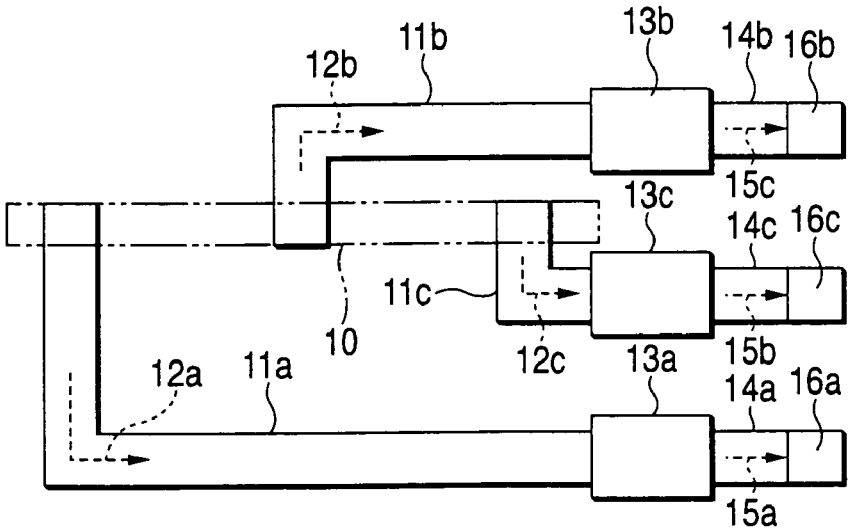
FIG. 5 is a schematic plan diagram showing the heat treatment apparatus exhaust paths for describing an exhaust method of the heat treatment apparatus in the PDP manufacturing method of the embodiment pertaining to the invention.

FIG. 4 is a schematic front diagram showing exhaust paths of the heat treatment apparatus according to the embodiment of the invention. FIG. 5 is a plan diagram thereof.

As shown in FIG. 4, plural (three) first exhaust pipes 11 (11*a*, 11*b* and 11*c*) are disposed as exhaust paths at an upper portion of a heat treatment apparatus (baking furnace) 10. Exhaust gases 12 (12*a*, 12*b* and 12*c*) generated from the inside of the heat treatment apparatus 10 are discharged to the respective exhaust pipes 11 (11*a*, 11*b* and 11*c*).

As shown in FIG. 5, inlets of catalyst units 13 (13*a*, 13*b* and 13*c*) are connected to outlets of the first exhaust pipes 11 (11*a*, 11*b* and 11*c*), and second exhaust pipes 14 (14*a*, 14*b* and 14*c*) are connected to outlets of the catalyst units 13 (13*a*, 13*b* and 13*c*). Additionally, exhaust gases 15 (15*a*, 15*b* and 15*c*) are discharged from exhaust openings 16 (16*a*, 16*b* and 16*c*) of the second exhaust pipes 14 (14*a*, 14*b* and 14*c*) to the outside (e.g., the atmosphere) of the heat treatment apparatus 10.

It should be noted that, although there are three systems of exhaust paths in the present embodiment, the number of exhaust paths, the number of disposed exhaust pipes and the number of disposed catalyst units can be made optional.

Also, the first exhaust pipes 11, the catalyst units 13 and the second exhaust pipes 14 in the exhaust paths may be respectively disposed at optional angles as long as the exhaust gas is capable of being discharged.

In the present embodiment, because the exhaust paths of the heat treatment apparatus 10 are configured as described above, a chemical reaction with respect to impurities included in the exhaust gases 12 flowing into each of the first exhaust pipes 11 is accelerated by catalysts of the catalyst units 13. As a result, the impurities included in the exhaust gases 12 are decomposed, become harmless exhaust gases 15 (e.g., water vapor and carbon dioxide) and are discharged to the outside (e.g., the atmosphere) of the heat treatment apparatus 10.

It should be noted that it is preferable to administer a heating/protective countermeasure for preventing condensation at the vicinities (particularly portions disposed substantially horizontally) of the first exhaust pipes 11.

Examples of the structure formation step in the PDP manufacturing method of the present embodiment include a bus electrode formation step, a partition wall formation step, a phosphor layer formation step and a black stripe layer (outside light reflection prevention layer) formation step.

The bus electrode formation step is, for example, a step where a glass paste including a mixture of silver powder, glass powder, resin and a solvent is coated to form a precursor layer having a dielectric layer, the dielectric layer precursor layer is transferred to a substrate, and this is calcinated thereafter.

Also, the partition wall formation step is, for example, a step where a glass paste including a mixture of glass powder, resin and a solvent is coated as a thick film on a substrate and dried, sandblasted via a predetermined mask, and this is calcinated thereafter.

Also, the phosphor layer formation step is, for example, a step where a phosphor paste including a mixture of phosphor powder, resin and a solvent is filled and coated between partition walls, and this is calcinated thereafter.

Also, the black stripe layer (outside light reflection prevention layer) formation step is, for example, a step where black paste including a mixture of an inorganic black pigment, resin and a solvent is coated between bus electrodes forming non-display lines, and this is calcinated thereafter.

Figure 6:
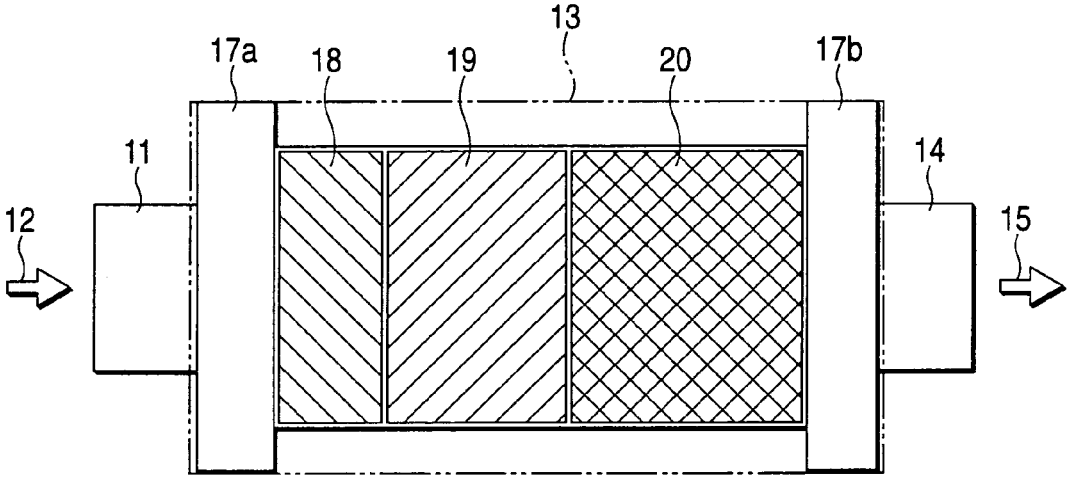
FIG. 6 is a cross-sectional diagram showing an example of the configuration of a catalyst unit.

FIG. 6 is a cross-sectional diagram showing an example of the configuration of each catalyst unit 13.

As shown in FIG. 6, pipe connectors 17*a* and 17*b* are disposed in the catalyst unit 13. The pipe connectors 17*a* and 17*b* are respectively connected to the first exhaust pipe 11, into which the untreated exhaust gas 12 flows, and the second exhaust pipe 14, which discharges the purified exhaust gas 15. An exhaust heating heater 18, which is used in accordance with the need for catalyst stability, a filter 19, which is used when a lot of mist or the like is included in the untreated exhaust gas 12, and a catalyst 20 are interconnected from the pipe connector 17*a* connected to the first exhaust pipe 11 towards the pipe connector 17*b* connected to the second exhaust pipe 14.

In the case of this example configuration, the untreated exhaust gas 12 flowing in from the pipe connector 17*a* connected to the first exhaust pipe 11 is first warmed by the exhaust heating heater 18 to a suitable temperature so that it easily reacts due to the action of the catalyst. Next, impurities whose volume is large, such as mist, are removed by the filter 19. Finally, in the catalyst 20, the impurities chemically react due to the action of the catalyst 20, are changed to harmless substances, and discharged from the second exhaust pipe 14 to the outside as the purified exhaust gas 15.

It should be noted that the exhaust heating heater 18 and the filter 19 do not always have to be used and may be used as needed.

Next, a table in which the properties of various catalysts are structurally/compositionally-distinguished and compared will be shown in FIG. 10 using examples of catalysts that can be applied as the catalyst 20 of the catalyst unit 13 in the present embodiment.

As shown in FIG. 10, examples of the catalyst 20 with which the catalyst unit 13 is provided include a metal honeycomb catalyst, a ceramic honeycomb catalyst and a pellet catalyst.

Examples of the metal honeycomb catalyst include a catalyst in which a catalyst-active substance such as a platinum group is added to a honeycomb structure of a metal (Fe—Cr—Al) that is a catalyst base material.

Other examples include a ceramic honeycomb structure of $SiO_2$—$Al_2O_3$—MgO and a pellet structure of r-$Al_2O_3$.

The structure of the catalyst of the honeycomb structure will be described using FIG. 7. This is a structure in which a coating agent such as a wash coat is coated on a catalyst base material formed in a honeycomb structure and a catalyst-active substance is adhered to the surface of the wash coat.

Figure 7:
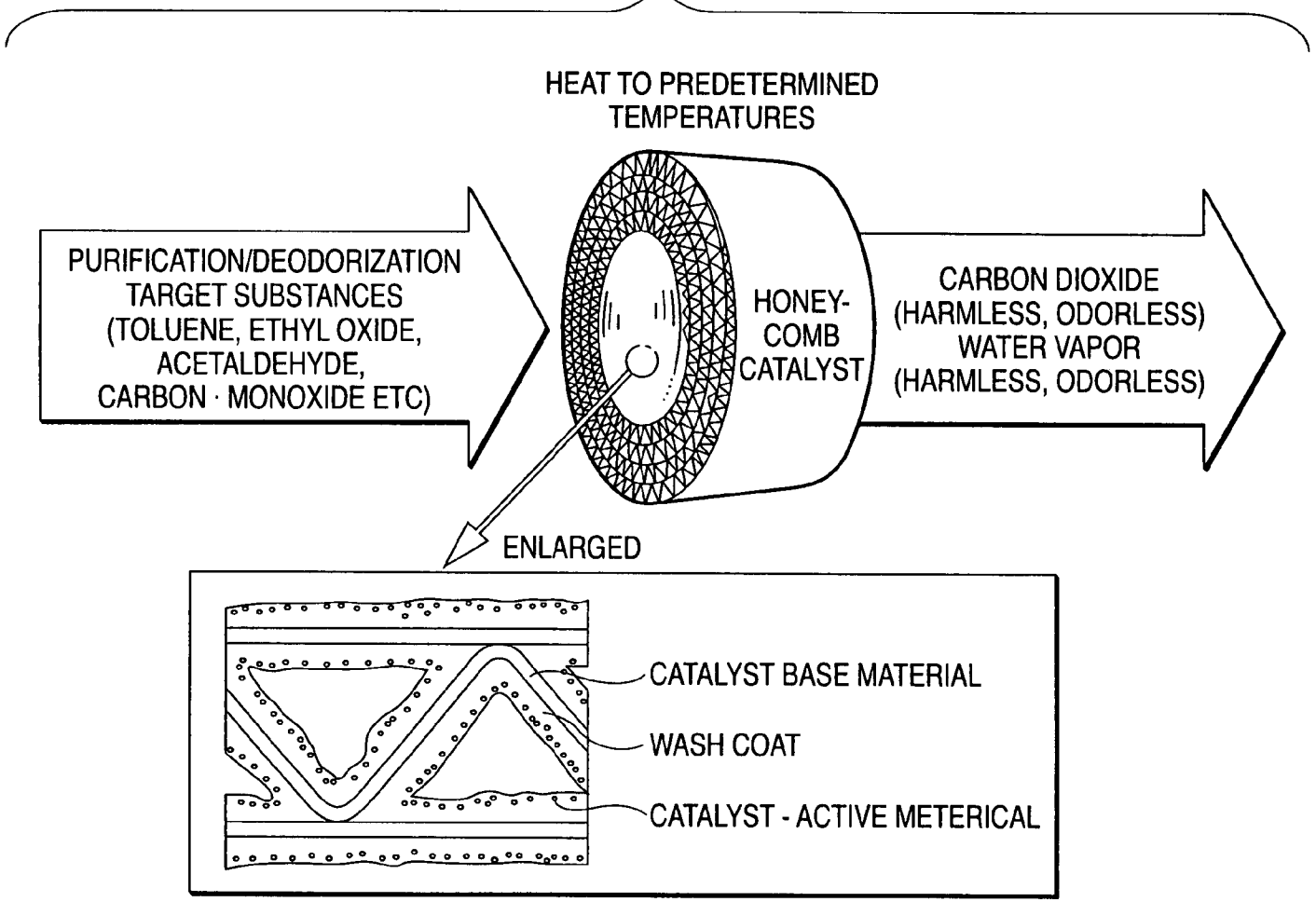
FIG. 7 is a diagram describing a catalyst of a honeycomb structure.

Additionally, as shown in FIG. 7, when purification/deodorization target substances (volatile organic matter such as toluene, ethyl oxide, acetaldehyde, and carbon monoxide) have been passed through the catalyst of the honeycomb structure, a catalytic oxidative reaction occurs, the target substances are changed to carbon dioxide and water vapor, and the exhaust gas is purified/deodorized.

Figure 8:
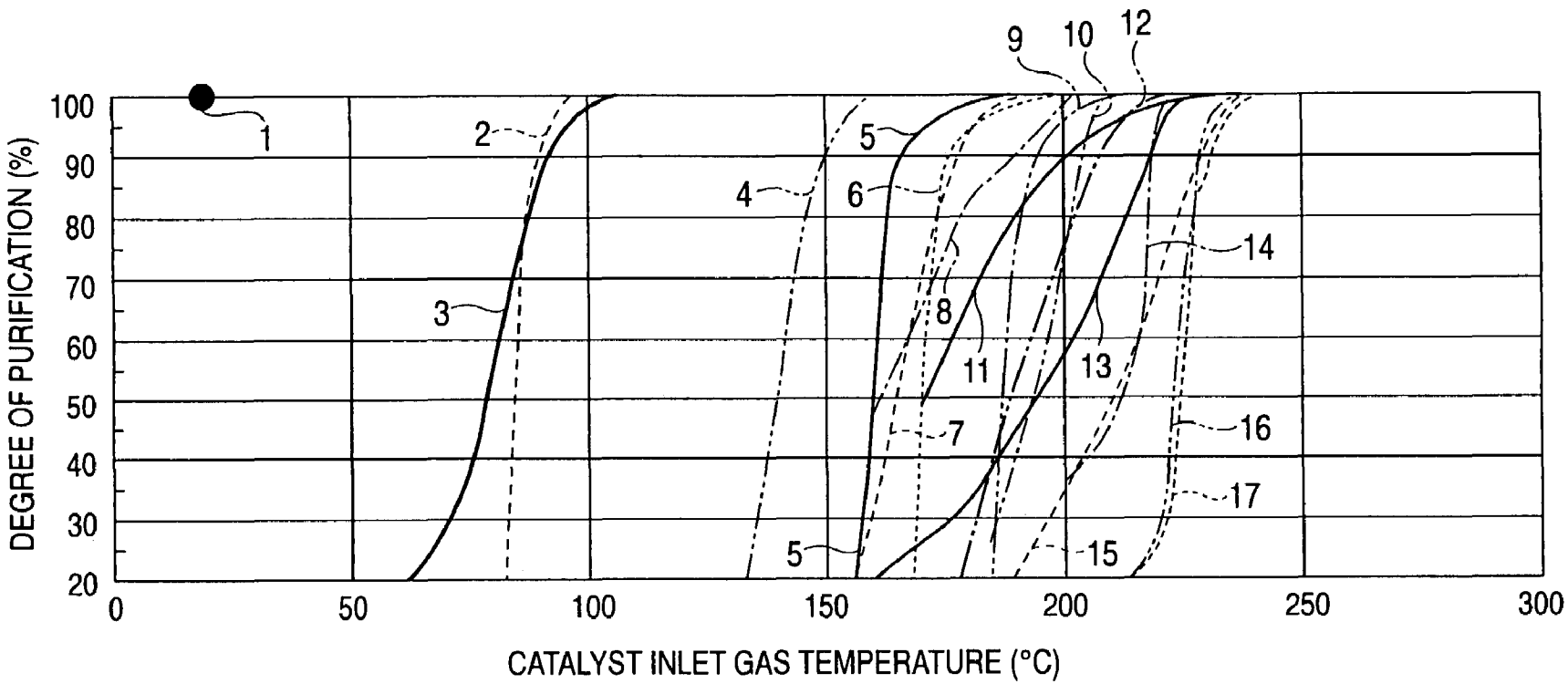
FIGS. 8 are a Graph (a) of purified properties (degree of purification with respect to catalyst inlet gas temperature) when various substances included in untreated exhaust gas have been purified using a metal honeycomb structure and a Table (b) of the concentration and space velocity of the various substances.

Next, a Graph (a) of purified properties (degree of purification with respect to catalyst inlet gas temperature) when the various substances included in the untreated exhaust gas 12 have been purified using the metal honeycomb catalyst and a Table (b) of the concentration and space velocity of the various substances are shown in FIG. 8.

It should be noted that the numbers added to Graph (a) in FIG. 8 correspond to the types of substances shown in Table (b).

Next, the degrees to which the various impurities (gas components) were purified by the catalyst unit 13 of the present embodiment are shown in Table 1 in accordance with the treatment conditions thereof in regard to examples where the exhaust gas components (toluene, n-hexane, ethyl oxide, styrene monomer, formalin) were measured.

TABLE 1

Degree of Purification of Various Components

| Component | Concentration before Treatment | Degree of Purification | Catalyst Layer Temperature | S.V. |
|---|---|---|---|---|
| Toluene | 1,200 ppm | 99.7% | 250° C. | 20,000 $H^{-1}$ |
| | 1,200 ppm | 99.9% or higher | 300° C. | 20,000 $H^{-1}$ |
| | 1,000 ppm | 98.6% | 420° C. | 40,000 $H^{-1}$ |
| n-hexane | 2,100 ppm | 99.7% | 350° C. | 20,000 $H^{-1}$ |
| Ethyl Acetate | 1,320 ppm | 99.9% | 350° C. | 20,000 $H^{-1}$ |

TABLE 1-continued

Degree of Purification of Various Components

| Component | Concentration before Treatment | Degree of Purification | Catalyst Layer Temperature | S.V. |
|---|---|---|---|---|
| Styrene Monomer | 5,000 ppm | 99.9% | 350° C. | 20,000 $H^{-1}$ |
| Formalin | 100 ppm | 99.4% | 350° C. | 20,000 $H^{-1}$ |

Catalyst used: KT301; degree of purification measured by gas-chromatography; catalyst layer about 15 ml.

With respect to the measurements of Table 1, KT301 (Pt pellet catalyst in which the diameters of the pellets were 2 to 4 mm) was used as the catalyst, and the degree of purification was measured by gas-chromatography under a condition in which the amount of the catalyst was about 15 ml.

Figure 9:
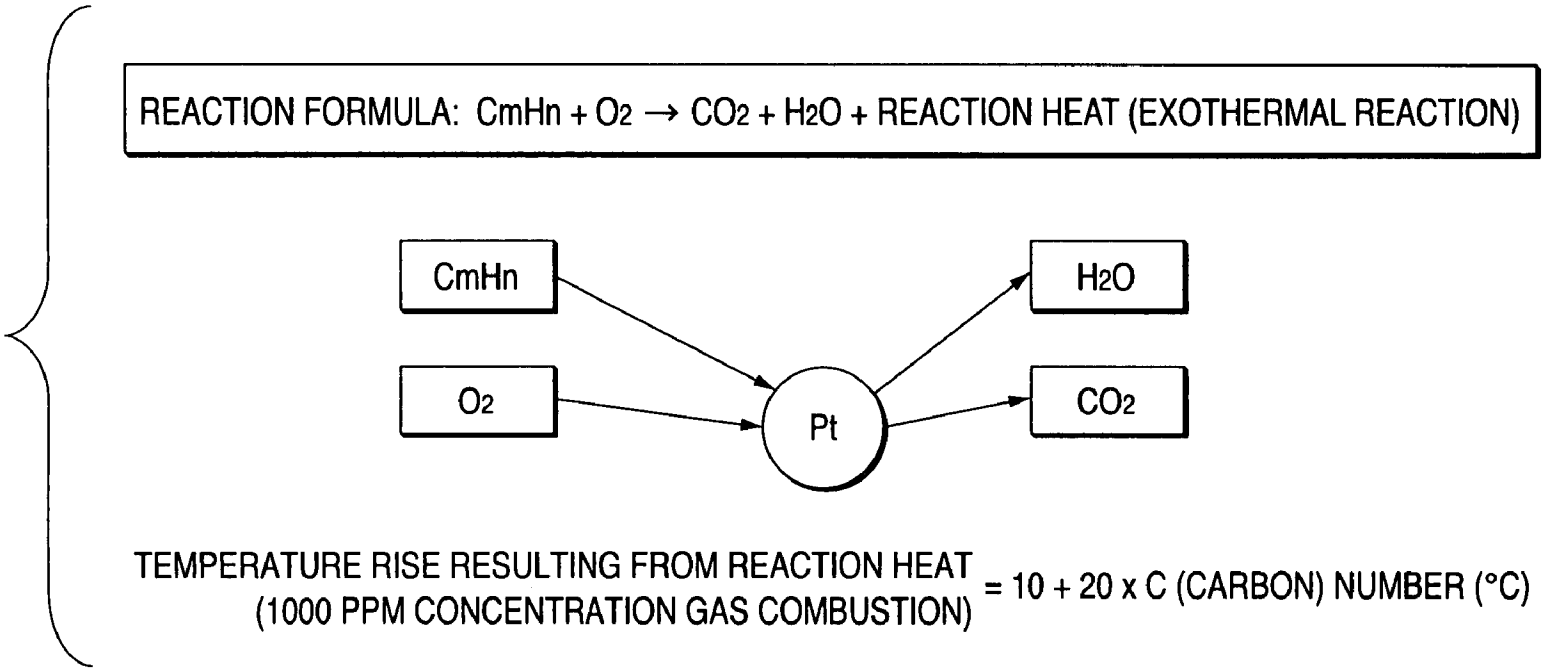
FIG. 9 is an explanatory diagram showing an example of a purification reaction when platinum (Pt) is used for a catalyst-active substance.

Also, a platinum (Pt) group is preferable for the catalyst-active substance used for the catalyst, and examples thereof include Pt, Pd, Ru, Rh, Ir and Os. FIG. 9 is an explanatory diagram showing an example of the purification reaction when platinum (Pt) is used for the catalyst-active substance.

As shown in FIG. 9, a chemical reaction between $C_mH_n$ (hydrocarbon) and $O_2$ (oxygen) included in the untreated exhaust gas 12 is accelerated by the catalytic action of the platinum (Pt), and the $C_mH_n$ and $O_2$ are converted to harmless $H_2O$ (water vapor) and carbon dioxide ($CO_2$) (the symbols "m" and "n" in the aforementioned $C_mH_n$ are integers).

Moreover, the effectiveness according to the various reactions relating to the platinum (Pt) group catalysts is shown in Table 2.

TABLE 2

Pt Group Catalysts Seen According to Reaction (O = effective)

| Reaction | Pt | Pd | Ru | Rh | Ir | Os |
|---|---|---|---|---|---|---|
| Hydrogenation Reaction | O | O | O | O | O | |
| Oxidation Reaction | O | O | O | O | O | |
| Dehydrogenation Reaction | O | O | | | | |
| Hydrogenolysis Reaction | O | O | O | | | |
| Ammonia Synthesis | | | O | | | |
| Methanol Synthesis | | O | | | | |
| Hydrocarbon Synthesis | | | O | | | |
| Acetic Acid Synthesis | | | | O | | |
| Hydroformylation Reaction | | | O | O | O | |
| Carbonylation Reaction | | | | O | | |
| Cis-hydrooxylation Reaction | | | | | | O |

Figure 1:
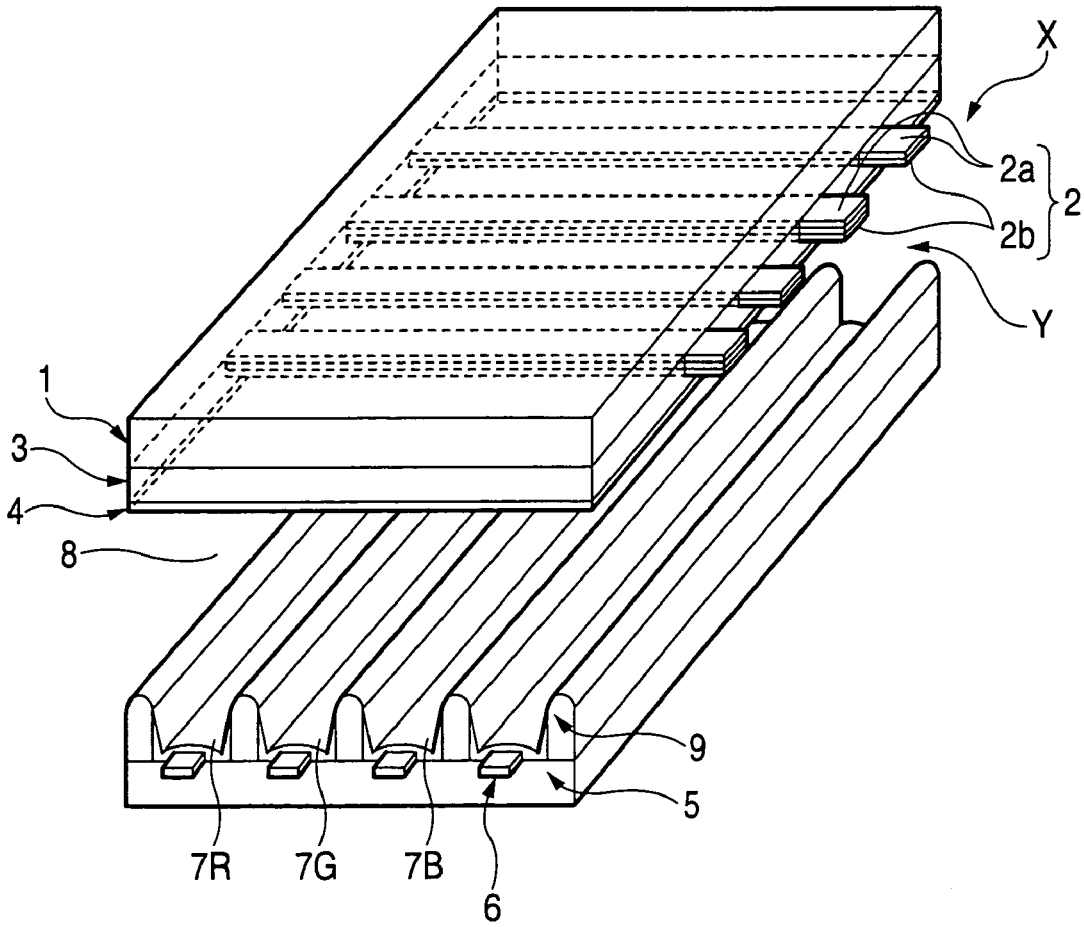
FIG. 1 PRIOR ART
FIG. 1 is an exploded perspective diagram showing the internal structure of a PDP.
Figure 2:
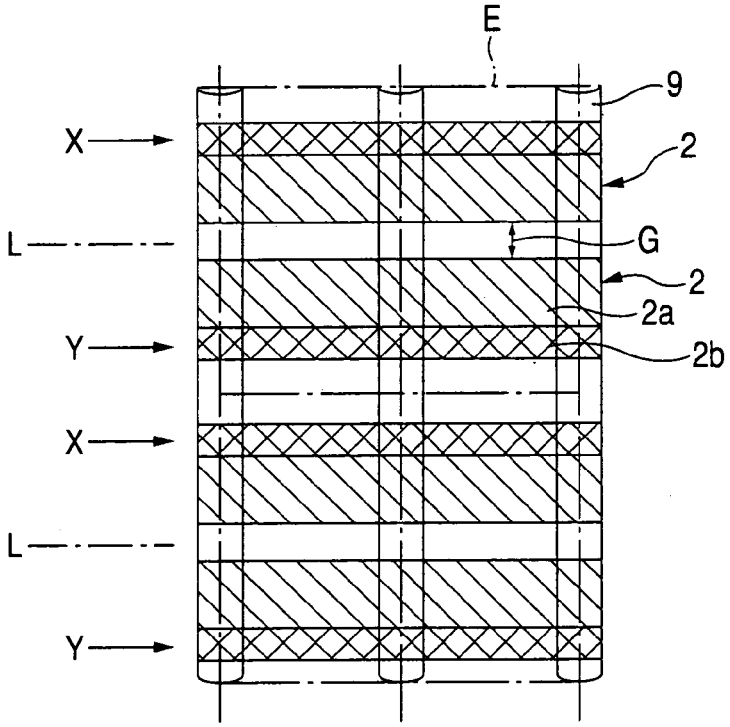
FIG. 2 PRIOR ART
FIG. 2 is a plan diagram schematically showing the structure of row electrode pairs of the PDP.
Figure 3:
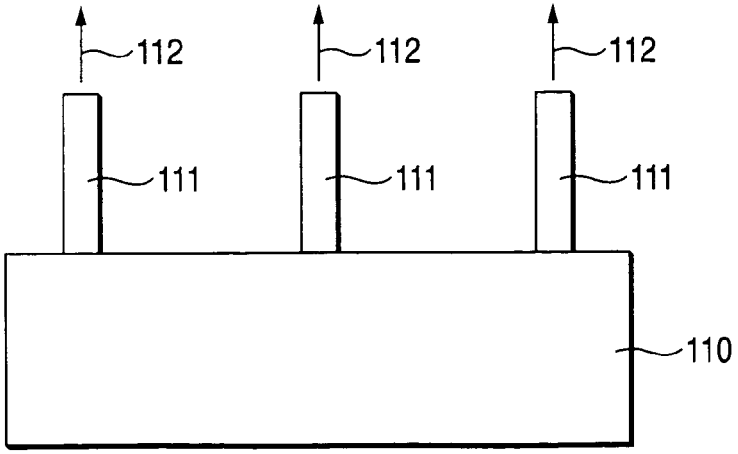
FIG. 3 PRIOR ART
FIG. 3 is a schematic diagram describing an exhaust gas exhaust method of a heat treatment apparatus.

In FIG. 3, the "O" mark indicates the type of platinum (Pt) catalyst for which the reaction shown in the corresponding row is effective.

Next, results where manufacture was conducted by the PDP manufacturing method according to the present embodiment and the amounts of various gases (impurities) discharged to the outside (the atmosphere) from the second exhaust pipe 14 were measured before and after introducing the catalyst 20 to the catalyst unit 13 of the heat treatment apparatus 10 are shown in Table 3 (before introducing the catalyst) and Table 4 (after introducing the catalyst).

TABLE 3

| Before Introducing the Catalyst | | | | | | |
|---|---|---|---|---|---|---|
| Gas Name | Detectable Gas | Atmospheric Temperature Inside Furnace | 100° C. | 250° C. | 400° C. | 400° C. |
| | | Exhaust Velocity | 6 m/sec | 6 m/sec | 3.7 m/sec | 3.7 m/sec |
| | | Catalyst Unit Inlet Temperature ° C. | 350° C. | 350° C. | 350° C. | 350° C. |
| Higher Hydrocarbons | Octane/decane/nonane/hexane/heptane | | 150 | 100 | 150 | 100 |
| Styrene | Divinylbenzene | | 2.0 | >25 | >25 | 3.0 |
| Ethyl Oxide | Ethyl acrylate/methyl acrylate/isopropyl ether | | 5.0 | 100 | 40 | 15 |
| Acetone | Brobionaldehyde | | 0 | 180 | 60.0 | 10.0 |

Unit: PPM

TABLE 4

| After Introducing the Catalyst | | | | | | |
|---|---|---|---|---|---|---|
| Gas Name | Detectable Gas | Atmospheric Temperature Inside Furnace | 100° C. | 250° C. | 400° C. | 400° C. |
| | | Exhaust Velocity | 6 m/sec | 6 m/sec | 3.7 m/sec | 3.7 m/sec |
| | | Catalyst Unit Inlet Temperature ° C. | 350° C. | 350° C. | 350° C. | 350° C. |
| Higher Hydrocarbons | Octane/decane/nonane/hexane/heptane | | 0 | 0 | 0 | 0 |
| Styrene | Divinylbenzene | | 0 | 0 | 0 | 0 |
| Ethyl Oxide | Ethyl acrylate/methyl acrylate/isopropyl ether | | 0 | 0 | 0 | 0 |
| Acetone | Brobionaldehyde | | 0 | 0 | 0 | 0 |

Unit: PPM

It should be noted that GV-100S+NO. 340 (gas sampler and hot probe manufactured by GASTEC Corporation) was used for the measurements of Table 3 and Table 4 and that a detector tube manufactured by GASTEC Corporation was used for the gas detector tube.

As shown in the measurement results of Table 3, impurities (higher hydrocarbons, acetone, ethyl oxide and styrene) included in the exhaust gas were detected before the introduction of the catalyst. However, as shown in the measurement results of Table 4, when the catalyst was used, impurities (higher hydrocarbons, acetone, ethyl oxide and styrene) included in the exhaust gas were not detected.

As described in detail above, in the present embodiment, the PDP manufacturing method includes forming a structure, wherein the forming of the structure includes forming a precursor layer containing at least one of a resin component and a solvent component on a substrate, and heat-treating the substrate on which the precursor layer has been formed; and decomposing impurities included in exhaust gas generated in the heat treatment by action of a catalyst. Thus, for example, impurities generated in the heat treatment when a structure such as, for example, an electrode, a partition wall, a phosphor layer, a dielectric layer and an outside light reflection prevention layer of a PDP are formed can be purified and discharged to the outside (the atmosphere).

Also, according to the heat treatment apparatus 10 of the present embodiment, the heat treatment apparatus 10 is used in a heat treatment where a substrate, on which is formed a precursor layer including at least one of a resin component and a solvent component, is heat-treated. The catalyst units 13 including the catalyst 20 are disposed on exhaust paths where exhaust gases generated in the heat treatment step are discharged. Thus, by using the heat treatment apparatus 10 in the heat treatment when a structure such as, for example, an electrode, a partition wall, a phosphor layer, a dielectric layer and an outside light reflection prevention layer of a PDP are formed, impurities generated in the heat treatment of these can be purified and discharged to the outside (the atmosphere).

What is claimed is:

1. A plasma display panel manufacturing method comprising:

forming a structure, wherein the forming of the structure includes forming a precursor layer containing at least one of a resin component and a solvent component on a substrate, and heat-treating the substrate on which the precursor layer has been formed; and decomposing impurities included in exhaust gas generated in the heat treatment by action of a catalyst.

2. The plasma display panel manufacturing method according to claim 1, wherein the forming of the structure is forming an electrode.

3. The plasma display panel manufacturing method according to claim 1, wherein the forming of the structure is forming a dielectric layer.

4. The plasma display panel manufacturing method according to claim 1, wherein the forming of the structure is forming a partition wall.

5. The plasma display panel manufacturing method according to claim 1, wherein the forming of the structure is forming a phosphor layer.

6. The plasma display panel manufacturing method according to claim 1, wherein the forming of the structure is forming an outside light reflection prevention layer.

* * * * *